US005788409A

United States Patent [19]

Johnson

[11] Patent Number: 5,788,409

[45] Date of Patent: Aug. 4, 1998

[54] DRAIN FIELD CONTAINER SYSTEM

[75] Inventor: Edward P. Johnson, Trappe, Md.

[73] Assignee: Johnson Family Limited Partnership-Four, Easton, Md.

[21] Appl. No.: 645,684

[22] Filed: May 14, 1996

[51] Int. Cl.[6] ..... E02B 11/00

[52] U.S. Cl. ..... 405/43; 210/170; 405/36; 405/52

[58] Field of Search ..... 405/36, 43, 52, 405/45, 38–41; 210/170

[56] References Cited

U.S. PATENT DOCUMENTS

| | | | |
|---|---|---|---|
| 3,919,848 | 11/1975 | Sullivan | 405/43 |
| 4,838,731 | 6/1989 | Gavin | 405/36 X |
| 4,971,690 | 11/1990 | Justice | 405/36 X |
| 5,154,353 | 10/1992 | Plachy | 405/36 X |
| 5,234,286 | 8/1993 | Wagner | 405/36 X |
| 5,322,387 | 6/1994 | Heine et al. | 405/36 |
| 5,378,357 | 1/1995 | Houck et al. | 405/36 X |
| 5,511,904 | 4/1996 | Van Egmond | 405/36 X |
| 5,597,264 | 1/1997 | Laak | 405/36 |

*Primary Examiner*—Dennis L. Taylor
*Attorney, Agent, or Firm*—Kirkland & Ellis

[57] ABSTRACT

A drain field container system for use in filtering sewage water from a distribution box. A plurality of separate containers are used to receive equal amounts of sewage water from distribution pipes extending from a distribution box. Sewage water is dispensed from the distribution pipe onto a dispersal tray inside the distribution box. The dispersal tray ensures equal distribution of sewage water across a filter located below the dispersal tray and extending across a lower portion of the drain field container. Sewage water is filtered in the filter before exiting the drain field container from an outlet on the bottom thereof. The drain field containers are made of rugged waterproof materials such as fiberglass. The drain field containers have a removable top portion to allow easy servicing and maintenance. A bubble top may also be employed to prevent dirt from accumulating on top of the drain field container. The drain field containers may be buried under ground and arranged in any desired manner to conform to the dimensions of the owners property.

28 Claims, 7 Drawing Sheets

20
3
10
14
30
33
34
35
36
37

DRAIN FIELD CONTAINER SYSTEM

BACKGROUND OF THE INVENTION

An improved drain field apparatus for filtering sewage water, so that by the time it leaves the drainage container, to either percolate into the ground or to drain off into a storm drainage system, the sewage water will be free of solids and will have a safe PH level. The inventive apparatus is designed to have modular prefabricated drain field containers that can sit beside each other or can be arranged in any desired configuration to fit within the owner's property.

SUMMARY OF THE INVENTION

Drain fields are commonly used in conjunction with a septic tank and distribution box in order to filter particulates from sewage water before the water enters the earth surrounding the drain field or the storm drain system. Drain fields typically consist of pipes or laterals with perforations along the bottom thereof, buried in a tile trench surrounded by a filter medium such as pea stone or sand. As explained more fully in the co-assigned U.S. Pat. No. 5,383,974, incorporated herein by reference, in such systems sewage water from a household is separated into solids, sewage water, and surface scum in the septic tank and then the sewage water travels from the septic tank to a distribution box. The distribution box then distributes the sewage water to the drain field where the sewage water is filtered before exiting the system. One problem with conventional drain fields is that the majority of the sewage water tends to be dispersed into the ground only along a short section of the overall drain field. This causes rapid erosion of the filter materials along this section, lessening the amount of filtering action. This "funneling effect" reduces the effectiveness of conventional drain fields and fixing the drain field requires the relatively expensive and time consuming process of digging up the drain field and replacing it with a new one. The present invention is an improved drain field that substantially eliminates these problems.

In the present invention, the conventional drain field is replaced with a series of modular drain field containers. The drain field containers are constructed of sturdy waterproof materials such as fiberglass or plastic. The water tight containers have top, bottom and side walls. The pipes from a distribution box enter each drain field container individually and dispense the sewage water across the length and width of the container. Filtering materials in the container ensure proper filtering of sewage water before the water can exit the water tight container through an outlet located at the bottom of the container. The containers can be arranged in any desired configuration on the owner's property all at the same depth. The tops of the containers are removable to allow easy access for maintenance or servicing of the system.

In accordance with the preferred embodiment of the instant invention, the container has a dispersal pan extending across a horizontal cross section of the container, located between the outlet of the distribution pipe and the filter in the drain field container. Sewage water from the distribution box is poured onto a cone at the center of the pan to distribute the water evenly across the pan. The pan has radial channels extending outwardly from the center cone to ensure even distribution of the sewage water across the pan. Within the radial channels are holes allowing the sewage water to fall from the pan onto the filter below. The diameter of the holes increases as the distance from the center cone increases to further ensure equal distribution of the sewage water across the filter.

In accordance with one embodiment of the invention, the container has an outlet on its bottom consisting of a pipe at one end. The bottom of the container narrows into a "V-shaped" channel to accumulate filtered sewage water. The channel slants downward to cause the filtered water to flow into the outlet. The outlet can then be attached to a pipe, which pipe can lead to a storm drain. This embodiment is designed for the areas of the country where storm drains are used.

In accordance with another embodiment of the invention, the outlet at the bottom of the drain field container consists of a series of holes to allow equal percolation of the filtered water into the ground. This embodiment of the invention is designed for those areas of the country where filtered sewage water is percolated directly into the ground.

Another aspect of the invention is the ability to bury all the drain field containers under ground at the same depth while maintaining equal distribution of sewage water among all the containers. To facilitate this aspect of the invention, the drain field containers may be constructed with additional distribution pipe connections for receiving distribution pipes leading to other drain field containers. This allows the containers to be buried in a straight line at the same depth while allowing equal distribution of sewage water to each of the drain field containers.

In another aspect of the invention, all the components of the system are made of waterproof materials such as fiberglass. These include the fasteners, for instance, bolts or clips, for removably securing the top to the rest of the drain field container. In a preferred embodiment, a bubble cover may also be provided. The bubble cover extends across the entire top of the container and is removably secured to the container. The bubble top prevents the top wall and its fasteners from being surrounded by compacted earth. Removal of the bubble top allows easy removal of the top of the container for maintenance or servicing, even in the worst of weather conditions.

DETAILED DESCRIPTION OF THE PREFERRED EMBODIMENT

Figure 1:
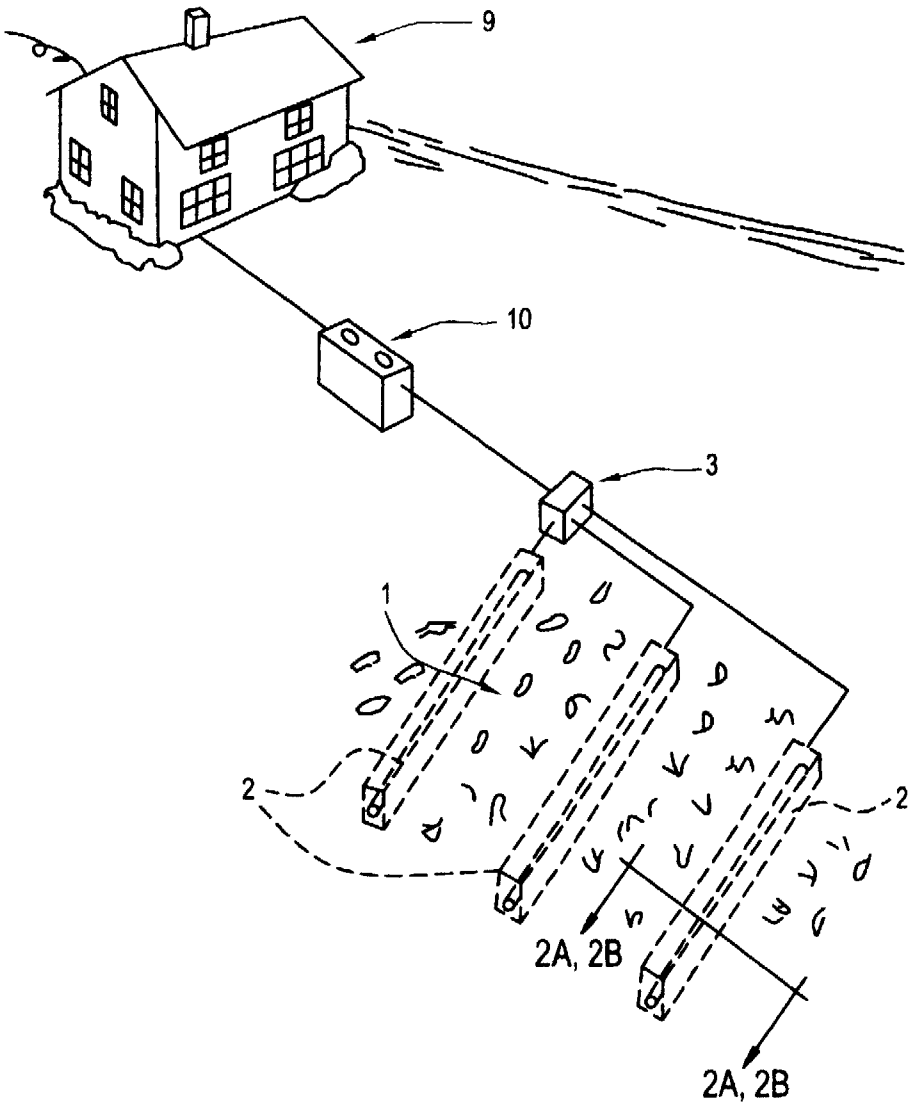
FIG.1 PRIOR ART
FIG. 1 is a diagram of a prior art drain field system.
Figure 2A:
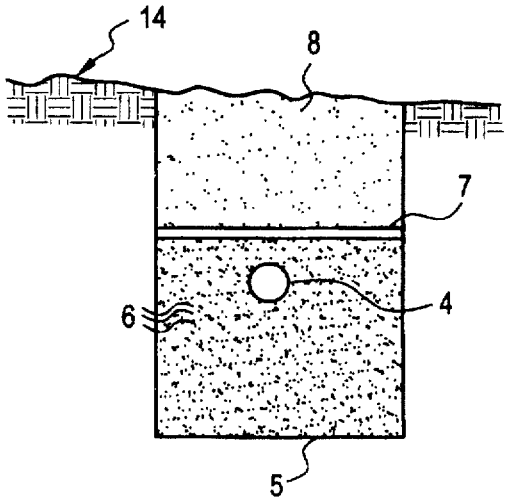
FIG.2A PRIOR ART
FIG. 2*a* is a cross sectional view of a prior art drain field that allows percolation into the ground.

In conventional prior art drain field systems, as shown in FIG. 1, the drain field 1 contains one or more drain field laterals 2, extending from a distribution box 3. The drain field laterals are buried in the drain field 1, also known as a tile field. As shown in FIG. 2*a*, each drain field lateral 2 consists of a slightly downwardly sloping pipe 4 typically having a diameter of 4 inches and a length of 50 feet. The drain field lateral 2 has series of holes along its bottom portion to allow sewage water from the distribution box to seep out of the lateral 2 into the drain field 1.

Each drain field lateral 2 is ordinarily buried about 20 to 30 inches below the ground level 14 in a long trench known as a tile trench 5. In colder climates, the drain field lateral 2 may be buried deeper to prevent the liquid in the pipe 4 from freezing. The drain field lateral 2 is placed in the tile trench 5 and surrounded by a filter bed 6 of gravel, sand or crushed stone to allow the sewage water to escape from the holes in the bottom portion of the drain field lateral 2. The filter bed 6 is then typically covered with a layer of untreated building paper or straw 7, which is itself covered with earth 8.

Figure 2B:
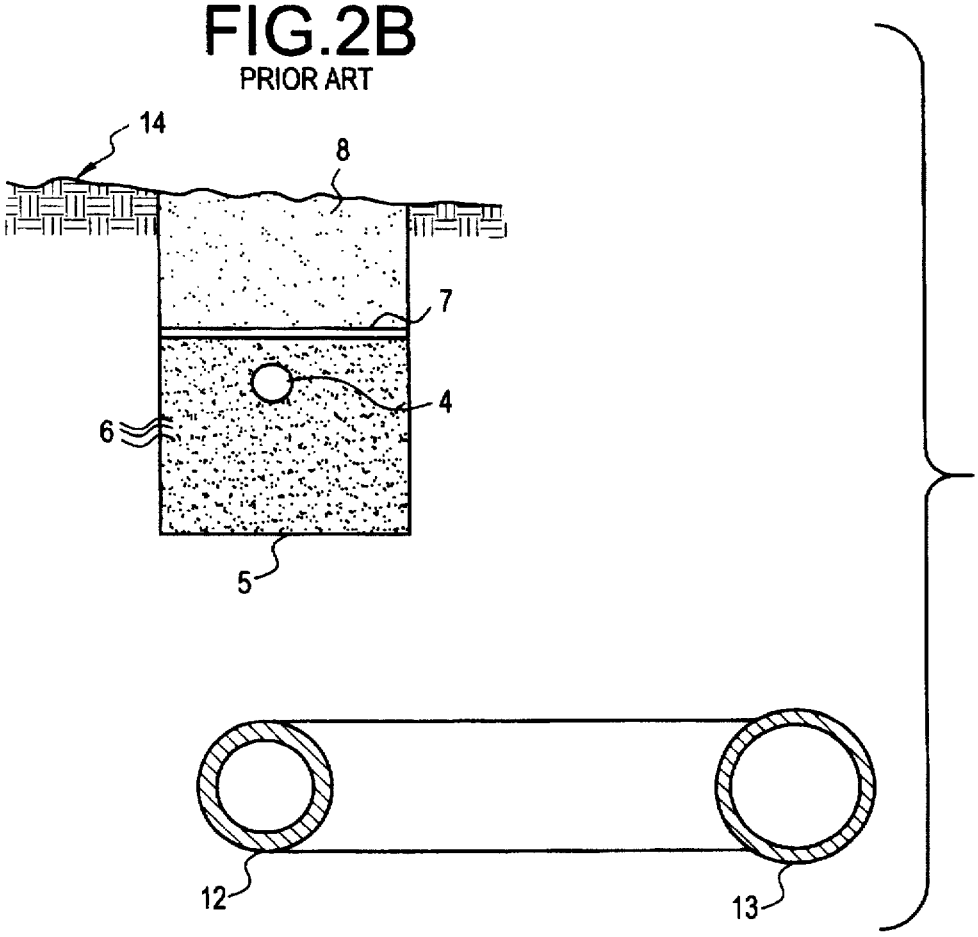
FIG.2B PRIOR ART
FIG. 2*b* is a cross sectional view of a prior art drain field that is used in areas with storm drains.

In use, sewage water passes from a household 9 into a septic tank 10, which separates the sewage water into solids, liquid, and surface scum. The sewage water passes from the distribution box 3 into the drain field lateral(s) 2. The sewage water then is distributed along the lateral 2 and dispersed through the holes in the laterals into the drain field 1. The sewage water is filtered of particulates as it passes through the sand or stone filter bed 6 in the tile trench 5. After passing through the drain field 1, the filtered sewage water percolates into the ground. In some areas, particularly where the ground has a high clay content that cannot absorb the water, the filtered sewage water is instead collected in pipe 12 below the lateral and released to a storm drain 13, as shown in FIG. 2*b*.

One significant drawback of the prior art system is that the majority of the sewage water tends to only be distributed into the drain field through only a small portion of the overall drain field lateral, normally the area closest to the distribution box. Because of the large quantity of sewage water that passes through the first series of holes in the drain field lateral 2, the drain field filter materials, typically sand or stone, tend to be eroded more quickly in these areas. With less sand or stone to impede the flow of sewage water through the holes in the bottom of the lateral, the rate of sewage water flow though this limited area increases, which causes an increase in the rate of erosion. This "a funneling effect" lessens the amount of filter materials, which in turn reduces the quality of filtering action, creating a potential health hazard. This is particularly true in those areas where storm drains are used. In order to restore the efficacy of the drain field, the drain field including the tile trench must be dug up, usually by using a backhoe. The drain field and drain field lateral must then be replaced. This is an expensive and time consuming process.

Figures 3, 4A, 4B, 4C:
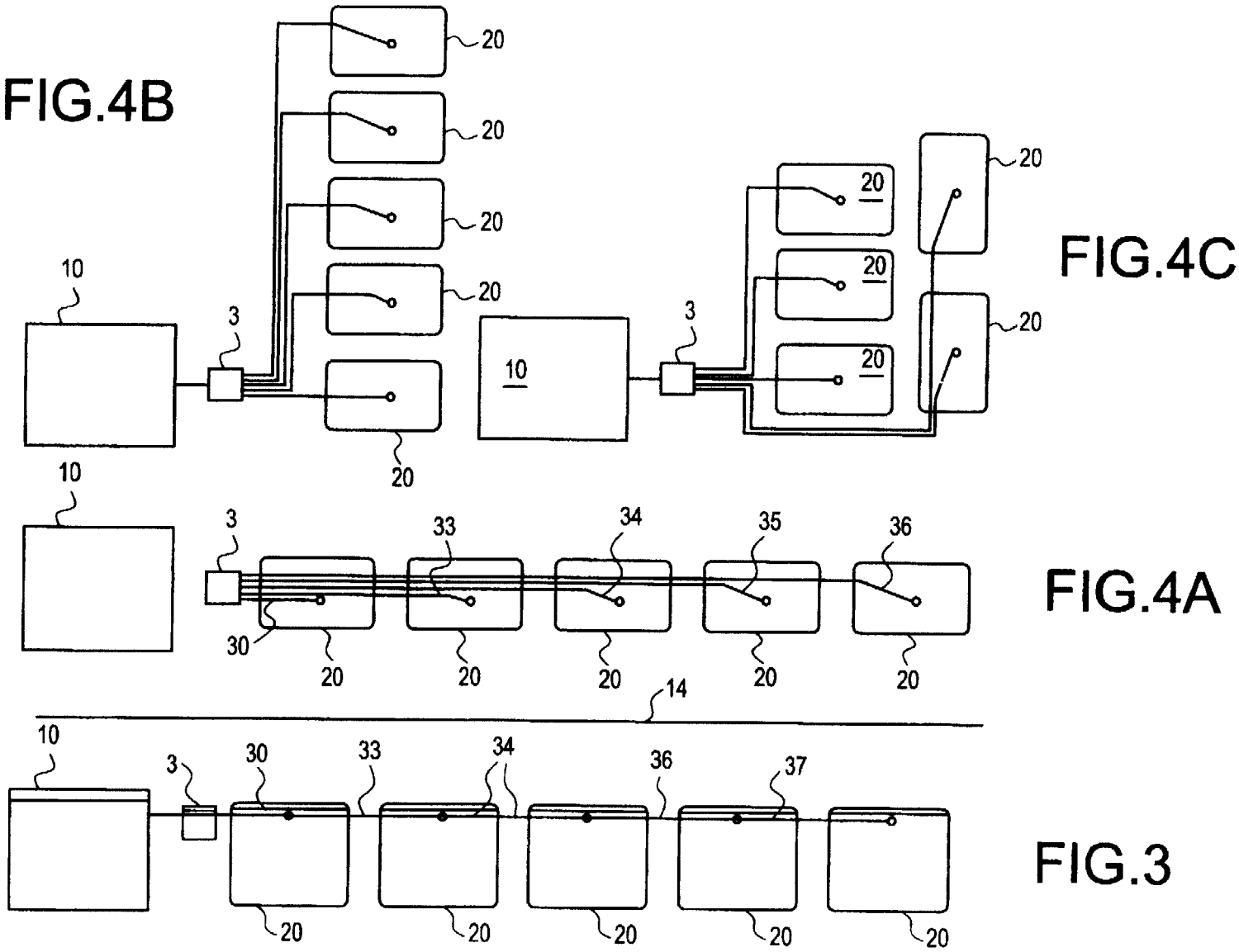
FIG. 3 is a side view of the drain field container system of the present invention.
FIG. 4*a* is a top view of the drain field container system of the present invention where the drain field containers are assembled in a straight line.
FIG. 4*b* is a top view of the drain field container of the present invention where the drain field containers are assembled next to each other in a row.
FIG. 4*c* is a top view of the drain field container of the present invention where the drain field containers are assembled in a third configuration.

The present invention is an improvement on the prior art drain field system. In the present invention, as shown in FIG. 3, a series of modular drain field containers 20 are employed instead of the conventional drain field laterals 2. Each of these drain field containers 20 receives an equal volume of sewage water from the distribution box 3 to filter and disperse into the earth or storm drain. Each of the drain field containers 20 is designed to ensure the sewage water is properly filtered before releasing it into the earth or storm drain.

The drain field container 20 is constructed of a sturdy water proof material, for example, fiberglass or plastic, that will not rust or rot. As shown FIGS. 5*a* and 5*b*, the integral watertight container 20 consists of top 21, bottom 22, and side walls 23. Because the entire drain field container is watertight, rain water cannot funnel into the system and unfiltered sewage water cannot escape from the container. In a preferred embodiment of the invention, the drain field container 20 is constructed to be approximately 3 feet wide, and 8 to 10 feet long. At least a portion of the top 21 of the container 20 is designed to be removable by any known means to provide convenient access to the container 20 and its contents. In a preferred embodiment, the top 21 is removable by means of fasteners 24, for instance, bolts or clips. Preferably, the fasteners 24 are also constructed of fiberglass or plastic. A rubber 0-ring or similar seal can be employed around the perimeter of the container where the top 21 is fastened to the body to maintain the watertight integrity of the container.

Figure 5A:
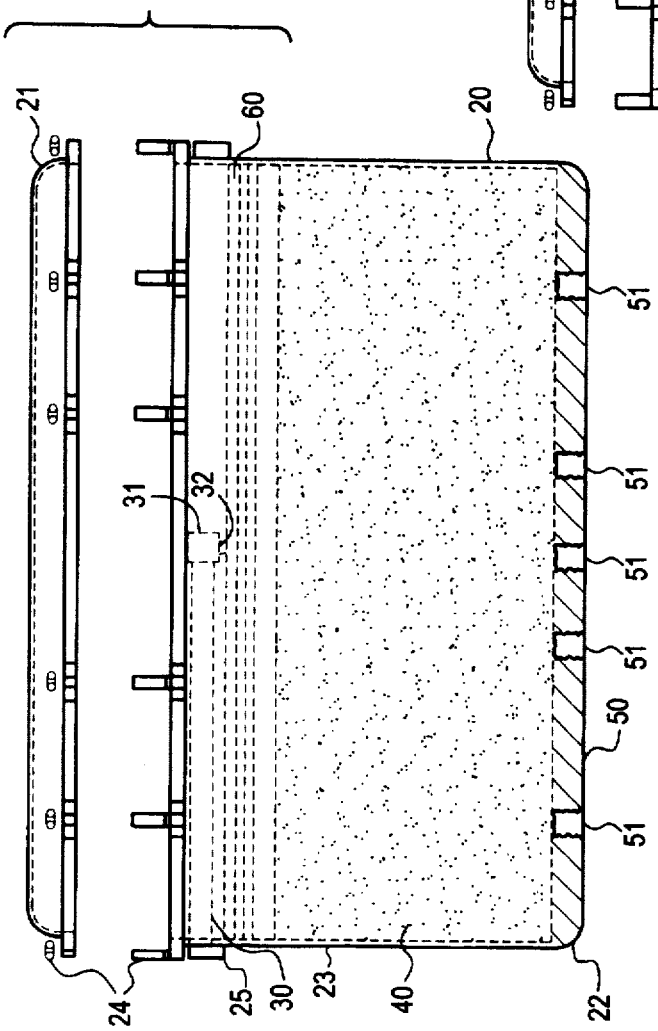
FIG. 5*a* is a side cross sectional view of a drain field container of the present invention for use in areas where filtered water percolates into the ground.
Figure 5B:
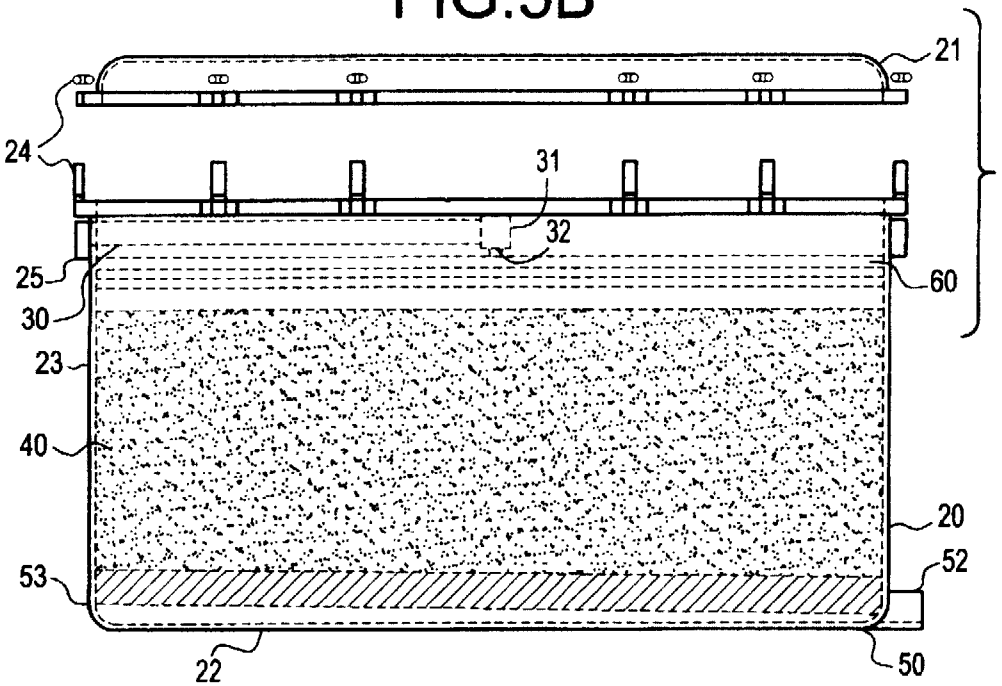
FIG. 5*b* is side cross sectional view of a drain field container of the present invention for use in an area where filtered water is released to a storm drain.

The drain field container has at least one connection 25 for receiving a distribution pipe 30 from a distribution box 3. For example, as shown in FIGS. 5*a* and 5*b*, the distribution pipe 30 may enter into one side of the drain field container 20 near the top portion 21. The outlet 31 of the distribution pipe is over the center of the of the drain field container. In a preferred embodiment, as shown in FIGS. FIGS. 5*a* and 5*b*, the outlet 31 of the distribution pipe contains a funnel 32 for directing the stream of sewage water from the distribution pipe 30 into the drain field container 20.

Figure 7:
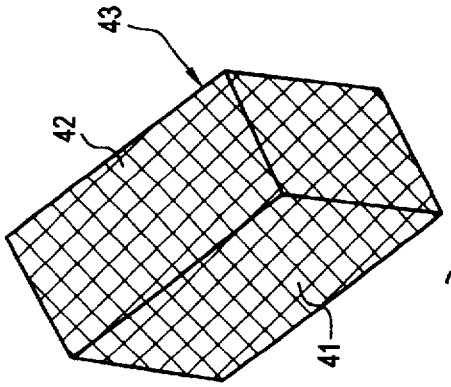
FIG. 7 is a view of a filter cartridge for use with the present invention.

As shown in FIGS. 5*a* and 5*b*, each drain field container 20 contains a filter 40 that extends across the bottom of the drain field container 20. The sewage water from the distribution pipe 30 pours onto the filter 40 and the filter 40 filters the sewage water. Because the sides of the drain field container 20 are waterproof, the water cannot seep out the sides of the container but must instead pass through the filter 40 in order to exit the container. The filter 40 contained in the drain field container 20 can be any conventional filter medium, including gravel, crushed stone, pea stone, or sand. In a preferred embodiment, as shown in FIG. 7, the filter 40 is specially designed to fit within the drain field container 20. The filter 40 can be constructed as a reusable synthetic fiber filter cartridge 41. For instance, the filter cartridge 41 can be constructed using a honeycombed nylon mesh 42 held in place by a plastic frame 43. This filter 41 can be coated with enzymes and special bacteria for treating sewage. The use of such a filter with the invention is particularly advantageous because the removable top allows the filter to be periodically cleaned and reactivated or changed without digging up the entire drain field system.

Figure 6A:
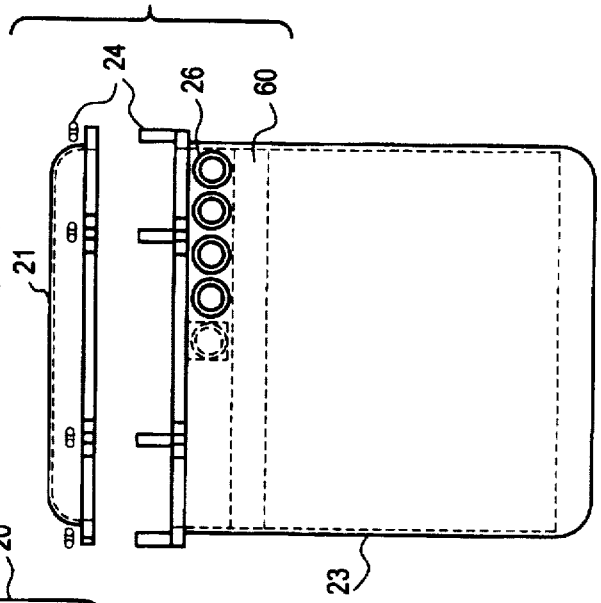
FIG. 6*a* is a front cross sectional view of the drain field container of the present invention for use in areas where the filtered water percolates into the ground.

At the bottom of the drain field container is the outlet 50. For areas where the sewage water is permitted to percolate into the earth, a first embodiment of the invention is used, as shown in FIG. 5*a* and 6*a*, where a number of holes 51 are located on the bottom side of the drain field container below the filter. Sewage water passes from the distribution box 3 into the drain field container 20, where it pours onto the filter 40. The water passes through the filter 40 and passes out of the container 20 through the outlet holes 51 and into the ground.

Figure 6B:
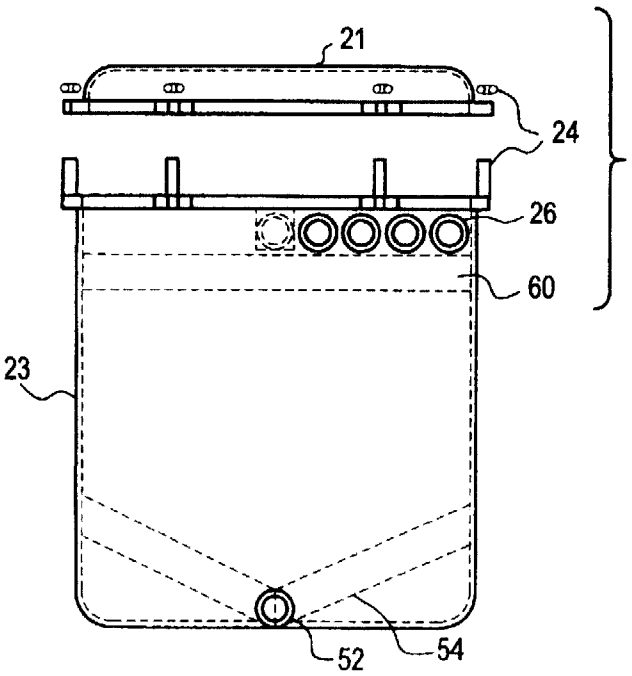
FIG. 6*b* is a front cross sectional view of the drain field container of the present invention for use in areas where the filtered water is released into a storm drain.

In a second embodiment of the invention, for use in areas that employ storm drains, the outlet 50 consists of an outlet pipe 52, as shown in FIGS. 5*b* and 6*b*, that extends to the outside of the container 20 for connection to the storm drain 13. The bottom of the drain field container is slanted 53 towards the outlet pipe and may also be angled to form a V-shaped channel 54 to further ensure the flow of filtered water into the outlet pipe 51. The outlet pipe 51 is connected to the storm drain 13.

Figure 8:
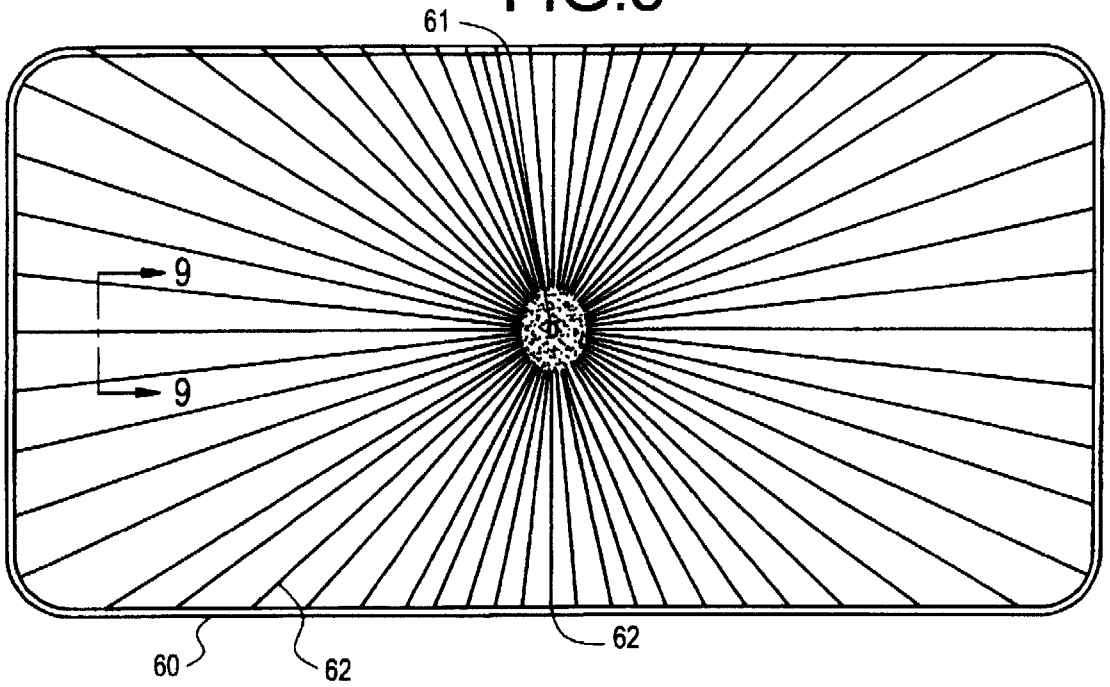
FIG. 8 is a top view of the disperser pan of the present invention.
Figure 9:
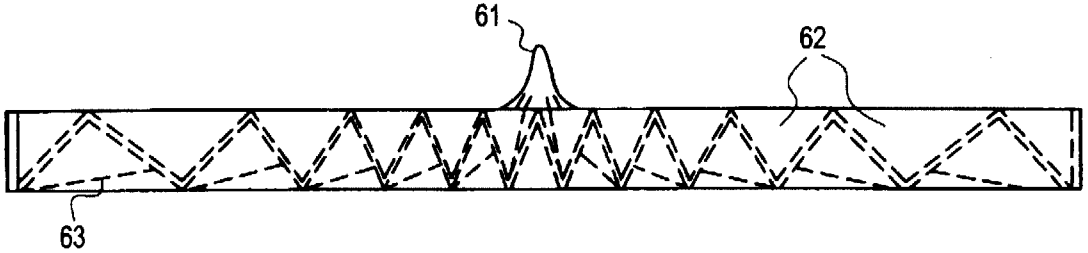
FIG. 9 is a side view of the disperser pan of the present invention.

In a preferred embodiment of the invention, a disperser pan 60, as shown in FIG. 8 is employed between the filter 40 and the outlet 31 of the distribution pipe 30. As shown in FIGS. 5*a*, 5*b*, 6*a*, and 6*b*, the pan 60 extends across the entire horizontal cross section of the drain field container above the filter 40. The disperser pan 60 is used to distribute the sewage water across the entire top surface area of the filter to ensure no single area receives substantially more flow than another. As shown in FIGS. 8 and 9, the pan 60 preferably contains a cone 61 at its center, which is aligned with the outlet 31 of the distribution pipe 30. A series of channels 62 are formed in the pan extending radially outwards from the cone 61 in the center. The channels 62 contain a number of holes 63 that increase in diameter as the distance from the cone 61 increases. The holes 63 allow water to pass through the disperser pan 60 onto the filter 40. Sewage water exiting the distribution pipe 30 pours onto the cone 61 and the cone 61 distributes the water radially outwards from the center of the pan into the radial channels 62. The sewage water then is evenly distributed across the surface area of the filter 40 below when the sewage water drips through the holes 63 in the channels 62.

The drain field containers 20 are designed to be buried underground like drain field laterals. In a preferred embodiment of the invention, as shown in FIGS. 3 and 4*a*–*c*, five to six drain field containers 20 are used in a system. Each has a separate connection 25 to the distribution box through a distribution pipe 30. The distribution pipe connections 25 to the distribution box 3 are located at the same height in the box so that an equal volumetric flow leaves the box and, correspondingly, flows into each of the distribution pipes 30 and then flows into each of the drain field containers 20. As shown in FIG. 3, the distribution pipes 30 slant downwardly from the box at a slight angle, for instance 1 degree, to allow gravity flow into the drain field containers 20.

Figure 10:
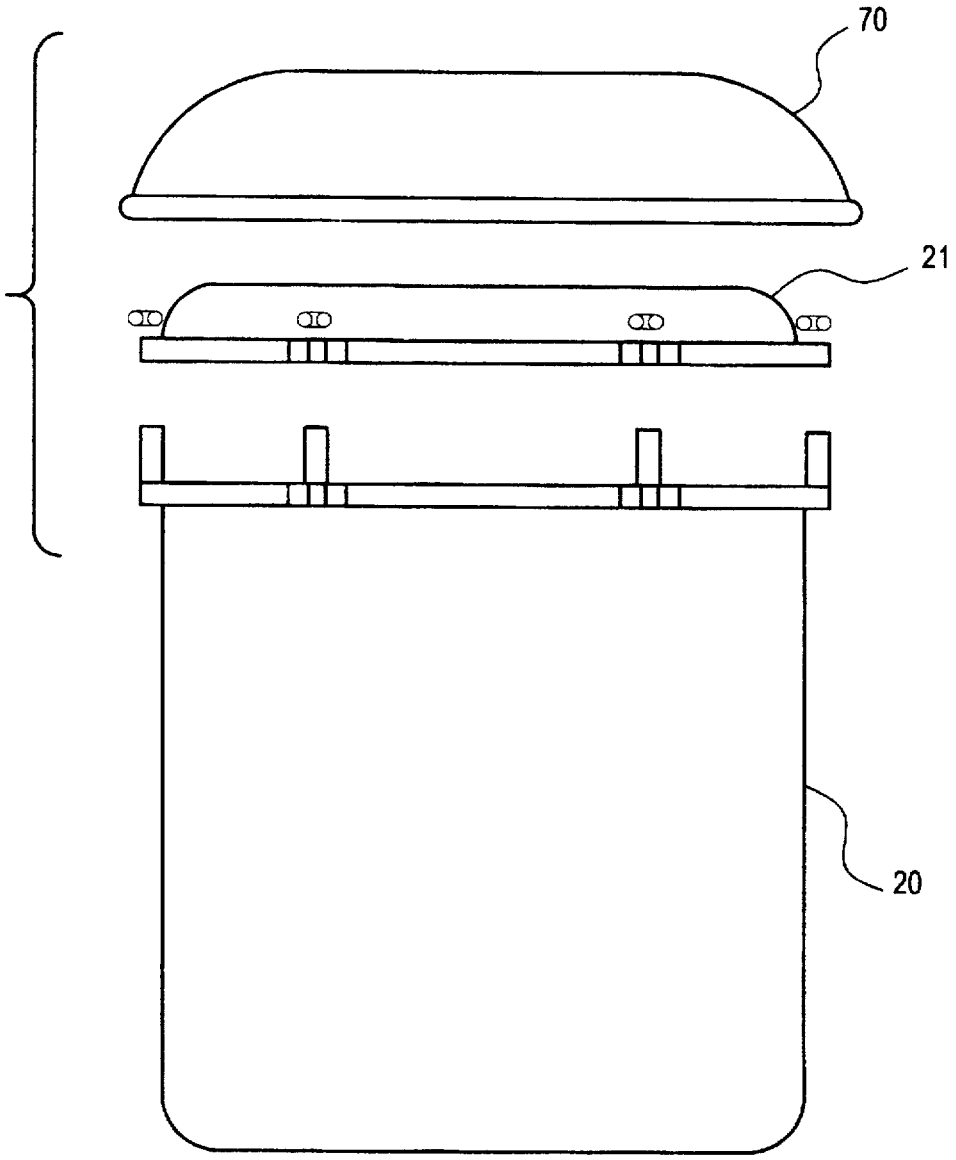
FIG. 10 is front view of the present invention with a bubble top.

The separate distribution pipe connections 25 allow the drain field containers 20 to be buried at the same depth below ground, unlike drain field laterals 2 that are buried progressively deeper as the lateral extends further from the distribution box 3. In one embodiment, the drain field containers 20 may be buried just below the surface of the ground and covered with artificial turf. This allows easy access to the drain field containers 20 for maintenence or service. If the drain field containers 20 are buried beneath the earth, to service the containers, only enough earth needs be removed so as to expose the top 21 of the container. The fasteners 24 may then be removed and the top 21 taken off for easy servicing. In the alternative, as shown in FIG. 10, a bubble top 70 may be employed with the drain field container to protect the top 21 from being encrusted with compacted earth or mud. The hard plastic or fiberglass bubble top 70 extends over the top of the drain field container protecting the container top 21 and its fasteners 24 from the surrounding dirt or mud. Once the bubble top 70 is dug up and removed, the top 21 of the drain field container 20, including the fasteners 24, is free of dirt allowing immediate removal of the top portion. The bubble top 70 can be held on top of the drain field container 20 by any known means such as clips or locking seams such as those commonly found on plastic containers.

One advantage of the modular design of the drain field containers 20 with separate connections to the distribution box is that the containers can be arranged in any desired manner to fit the dimensions of the owner's property. As shown in FIG. 4*b*, the drain field containers can be aligned next to each other in a row or, as shown in FIG. 4*c*, they may be arranged in a different shape to accommodate the plot of land. In an another alternative, as shown in FIGS. 3 and 4*a*, the drain field containers can be arranged in a straight line extending outward from a house. When the drain field containers are to be arranged in a straight line, the containers may be constructed with additional waterproof distribution pipe connections 26, as shown in FIGS. 6*a* and 6*b*, to receive the distribution pipes of the succeeding drain field containers. The distribution pipes 33, 34, 35, and 36, of succeeding drain field containers pass through the container without having any outlet 31 to the container.

The inventive drain field container system described above has numerous advantages over the prior art drain field systems. First, the funneling effect is diminished because the sewage water from the distribution box is equally distributed among a number of containers. Second, the containers are waterproof modular units that are designed to distribute the share of sewage water received therein equally across the filter. Third, the modular drain field containers are designed so that at least a portion of the top is removable so the filter medium can be replaced, cleaned, or treated with enzymes to facilitate cleaning. Fourth, the modular containers are easily unearthed and do not require a backhoe to dig up a trench, and the containers, unlike drain field laterals, are designed to last nearly forever. Fifth, the watertight containers prevents sewage water from escaping without being properly filtered. Sixth, the drain field containers may be arranged in any desired configuration to best meet the space needs of the owner's property.

It will be apparent to one of ordinary skill in the art from the foregoing description that variations of the foregoing apparatus may be employed without departing from the scope of the present invention. In addition, dimensions and measurements are given by way of example only, and are merely representative of the various modes of the invention.

What is claimed is:

1. A drain field system for use with a septic tank buried beneath the ground for receiving untreated sewage and filtering the sewage into solid waste, liquid waste, and surface scum, comprising:

a) a distribution box buried beneath the ground for connection to a septic tank for receiving said liquid waste from said septic tank and for distributing said liquid waste evenly between a plurality of distribution pipes;

b) a plurality of distribution pipes, each being connected at a first end to said distribution box, each sloping downward at a small angle from said first end to facilitate the flow of liquid waste therein from said first end to a second end, said second end extending into one of a plurality of drain field containers;

c) a plurality of drain field containers for burying beneath the ground, each connected to said distribution box by one of said distribution pipes, said drain field containers for filtering the liquid waste received from said distribution box through said distribution pipes, which distribution pipes discharge the liquid waste directly into said drain field containers, said drain field containers being constructed with top, bottom, and side portions, and wherein said top and side portions are substantially watertight;

d) a filter in each of said drain field containers for filtering the liquid waste received in said drain field containers;

e) an outlet in each of said drain field containers for allowing release of liquid waste passed through said filter out of said drain field container.

2. The drain field system of claim 1 wherein a disperser tray is positioned in each of said field containers between said second end of said distribution pipe and said filter, for receiving the liquid waste from said second end and dispersing it across said filter in said drain field container, said disperser tray constructed with a plurality of holes to facilitate the equal distribution of liquid waste across said filter.

3. The drain field system of claim 1, wherein said outlet comprises a series of holes in the bottom portion of said field container.

4. The drain field system of claim 1, wherein said outlet comprises a pipe extending out of said field container below said filter.

5. The drain field system of claim 1, wherein at least a portion of said top portion of said field container is removable.

6. The drain field system of claim 2, wherein said top portion is removably attached to the remainder of said field container by fasteners.

7. The drain field system of claim 1, wherein said field container is constructed of fiberglass.

8. The drain field system of claim 1, wherein said field container is constructed as a box having four side walls, a top and bottom wall.

9. The drain field system of claim 1, wherein one or more additional distribution pipes may extend through one or more field containers other than the field container where said second end of said distribution pipe is located.

10. The drain field system of claim 2, wherein said disperser pan is comprised of a convex cone located under said second end of said distribution pipe, and a plurality of channels extending radially outward from said convex cone, wherein said cone disperses the stream of liquid waste from said second end into said channels and said channels conduct said liquid waste radially across said drain field container.

11. The drain field system of claim 10, wherein said plurality of channels in said disperser pan have holes along the length of the channels.

12. The drain field system of claim 11, wherein said holes along the length of said channels increase in diameter as the channel extends from said convex cone.

13. The drain field system of claim 1, wherein said filter is comprised of a layer of pea stone or sand.

14. The drain field system of claim 1, wherein said filter is comprised of a removable honeycomb of synthetic fibers, treated with enzymes and bacteria for treating sewage, mounted in a rigid frame.

15. The drain field system of claim 1, wherein a bubble top is removably secured to the top portion of said drain field container, said bubble top comprising a water proof cover for preventing earth from coming into contact with the removable top portion of said drain field container.

16. A drain field container adapted for use in an underground drain field system, wherein the system includes a distribution box for distributing liquid waste equally to a plurality of drain field containers, and distribution pipes for distributing liquid waste from said distribution box directly into said drain field containers and dispensing said liquid waste into said drain field container through a nozzle portion, said drain field container comprising:

a) a unitary body having top, bottom, and side portions, said body adapted to receive a distribution pipe extending therein for carrying liquid waste;

b) a filter in said drain field container for receiving the liquid waste and filtering it of contaminants;

c) a disperser pan located above said filter for receiving said liquid waste from a distribution pipe nozzle portion and dispersing said liquid waste across said filter;

d) an outlet located below said filter for releasing filtered liquid waste from said field container.

17. The field container of claim 16, wherein said outlet comprises a series of holes in the bottom portion of said field container.

18. The field container of claim 16, wherein said outlet comprises a pipe extending out of said field container from below said filter.

19. The field container of claim 16, wherein said top portion of said field container is removable from said field container.

20. The field container of claim 19, wherein said top portion is removably attached to the remainder of said field container using fasteners.

21. The field container of claim 16, wherein said field container is constructed of fiberglass.

22. The field container of claim 16, wherein said field container is constructed as a box having four side walls, a top and bottom wall.

23. The field container of claim 16, wherein said disperser pan is comprised of a convex cone adapted to be located under a nozzle portion of a distribution pipe, and a plurality of channels extending radially outward from said convex cone, wherein said cone disperses the stream of liquid waste from a distribution pipe nozzle portion into said channels and said channels conduct said liquid waste radially across said field container.

24. The field container of claim 23, wherein said plurality of channels in said disperser pan have holes along the length of the channels.

25. The field container of claim 24, wherein said holes along the length of said channels increase in diameter as the channel extends from said convex cone.

26. The field container of claim 16, wherein said filter is comprised of a layer of pea stone or sand.

27. The field container of claim 16, wherein said filter is comprised of a removable honeycomb of synthetic fibers, treated with enzymes and bacteria for treating sewage, mounted in a rigid frame.

28. The drain field system of claim 16, wherein a bubble top is removably secured to the top portion of said drain field container, said bubble top comprising a water proof cover for preventing earth from coming into contact with the removable top portion of said drain field container.

* * * * *